US011779124B2

(12) United States Patent
Liu et al.

(10) Patent No.: US 11,779,124 B2
(45) Date of Patent: Oct. 10, 2023

(54) ZERO GAP FOLDABLE POWERED BED

(71) Applicant: HHC CHANGZHOU CORPORATION, Changzhou (CN)

(72) Inventors: Chih Hsiung Liu, Benoni (ZA); Mei Jun Xu, Jiujiang (CN); Hai Guo Jiang, Changzhou (CN); Kui Zhao, Changzhou (CN)

(73) Assignee: MOTOMOTION CHINA CORPORATION, Changzhou (CN)

( * ) Notice: Subject to any disclaimer, the term of this patent is extended or adjusted under 35 U.S.C. 154(b) by 0 days.

(21) Appl. No.: 17/210,661

(22) Filed: Mar. 24, 2021

(65) Prior Publication Data

US 2022/0304476 A1 Sep. 29, 2022

(51) Int. Cl.

| | |
|---|---|
| ***A47C 20/12*** | (2006.01) |
| ***A47C 20/08*** | (2006.01) |
| ***A47C 20/04*** | (2006.01) |
| ***A47C 19/12*** | (2006.01) |
| *A61G 7/002* | (2006.01) |

(52) U.S. Cl.

CPC ..... *A47C 20/12* (2013.01); *A47C 19/122* (2013.01); *A47C 20/04* (2013.01); *A47C 20/08* (2013.01); *A61G 7/002* (2013.01)

(58) Field of Classification Search

CPC ..... A47C 20/12; A47C 20/04; A47C 31/008; A47C 20/041; A47C 20/08; A47C 19/00; A47C 19/021; A47C 19/12; A47C 19/122; A61G 7/015; A61G 7/018; A61G 7/00; A61G 7/002; A61G 7/0573; A61G 2203/12

See application file for complete search history.

(56) References Cited

U.S. PATENT DOCUMENTS

| | | | | |
|---|---|---|---|---|
| 6,209,157 | B1 * | 4/2001 | Hensley | A47C 20/08 5/613 |
| 8,186,744 | B1 * | 5/2012 | Hanser | B60P 3/39 5/47 |
| 2008/0178388 | A1 * | 7/2008 | Schermel | A47C 27/001 5/613 |
| 2017/0209320 | A1 * | 7/2017 | Lo | A61G 7/015 |

* cited by examiner

*Primary Examiner* — David R Hare

*Assistant Examiner* — Deborah Talitha Gedeon

(74) *Attorney, Agent, or Firm* — LAW OFFICES OF STEVEN W. WEINRIEB

(57) ABSTRACT

A zero gap foldable powered bed comprises a bed frame and a sliding mechanism disposed upon said bed frame. The bed further comprises back, lumbar, seat, thigh, and leg decks operatively connected to the sliding mechanism, and the bed frame includes a head end frame member which is disposed within a vertically oriented plane. Linear actuators are operatively connected to the back and leg decks, and when the back deck is elevated or lowered, the sliding mechanism slides upon the bed frame so as to maintain the head end frame member, to which a headboard may be attached, within the vertically oriented plane such that a free end portion of the back deck will always be disposed immediately adjacent to the vertically oriented plane such that the back and shoulders of a person, lying or sitting upon the bed, will remain close to a nightstand, which may be disposed close to the bed, such that articles disposed upon the nightstand are always readily accessible.

14 Claims, 11 Drawing Sheets

ZERO GAP FOLDABLE POWERED BED

FIELD OF THE INVENTION

The present invention relates generally to beds, and more particularly to a new and improved zero gap foldable powered bed wherein the bed comprises a bed frame comprising head end frame member, a foot end frame member, a pair of longitudinally extending side frame members connected to the head end and foot end frame members, and several deck members pivotally connected together, such as, for example, a back deck member, a lumbar deck member, a pair of seat deck members, a thigh deck member, a foot deck member. A headboard is adapted to be fixedly connected to the head end frame member, and the bed is also adapted to be folded in half for easy storage and/or transportation. Still further, the bed includes a horizontally oriented sliding mechanism, slidably mounted upon the bed frame, such that when, for example, the back deck member of the bed is elevated, the entire sliding mechanism, upon which all of the deck members are disposed, will be moved toward the headboard of the bed such that the upper, free end portion of the back deck member will remain within a vertical plane predeterminedly established or defined by means of the head end frame member of the bed and the headboard attached thereto. In this manner, a person, lying in the bed, can easily access items disposed upon a nightstand, which may be located at a position adjacent to the bed, because the person's head, upper back portion, and/or shoulders, are effectively maintained within the same plane as the head end frame member upon which the vertically oriented headboard of the bed is fixedly mounted.

BACKGROUND OF THE INVENTION

Powered beds have of course become very popular in recent years. They enable one to configure a particular bed into a myriad of different states, positions, and configurations whereby some users like to have their backs in an elevated and forward position for, for example, reading, watching television, or for simple comfort. In addition, a particular person may choose to have their legs and feet elevated, either for comfort or medical reasons. In addition, people normally have nightstands located adjacent or close to their beds upon which they may place, for example, various items, such as, for example, radios, clocks, books, telephones, lamps, and the like. Normally, such items are easily and readily accessible and/or reachable by the person lying or sitting in or upon the bed, however, when, for example, the back deck of the bed has been elevated to such a position that the person's back is now supported in an elevated and forward position relative to, for example, the headboard of the bed, it sometimes occurs that the person, disposed in such position, cannot in fact easily and readily access or reach a particular item which has been placed upon the nightstand.

A need therefore exists in the art for a new and improved powered bed. An additional need exists in the art for a new and improved powered bed which comprises a back deck, a lumbar deck, a pair of seat decks, a thigh deck, a leg deck, and a headboard. Another need exists in the art for a new and improved powered bed which comprises a back deck, a lumbar deck, a pair of seat decks, a thigh deck, a leg deck, a headboard, and a sliding mechanism upon which the back deck, the lumbar deck, the pair of seat decks, the thigh deck, and the leg deck are disposed. Still another need exists in the art for a new and improved powered bed which comprises a back deck, a lumbar deck, a pair of seat decks, a thigh deck, a leg deck, a headboard, and a sliding mechanism upon which the back deck, the lumbar deck, the pair of seat decks, the thigh deck, and the leg deck are disposed, wherein the sliding mechanism is adapted to be moved in a rearward direction toward the headboard of the bed when the back deck of the bed, upon which the person's back is supported, is being elevated. Yet another need exists in the art for a new and improved powered bed which comprises a back deck, a lumbar deck, a pair of seat decks, a thigh deck, a leg deck, a headboard, and a sliding mechanism upon which the back deck, the lumbar deck, the pair of seat decks, the thigh deck, and the leg deck are disposed, and wherein the sliding mechanism is adapted to be moved in a rearward direction toward the headboard of the bed when the back deck of the bed, upon which the person's back is supported, is being elevated, whereby as the person is effectively moved from a supine position to a sitting position at which the person's back may be disposed at any predeterminedly selected comfortable angle, such as, for example, 45°, by means of the elevated back deck, the upper, free end or rear edge portion of the back deck of the bed effectively remains within a vertical plane corresponding to the plane within which the head end frame member of the underlying bed frame, as well as the headboard of the bed, is disposed. A further need exists in the art for a new and improved powered bed which comprises a back deck, a lumbar deck, a pair of seat decks, a thigh deck, a leg deck, a headboard, and a sliding mechanism upon which the back deck, the lumbar deck, the pair of seat decks, the thigh deck, and the leg deck are disposed, and wherein the sliding mechanism is adapted to be moved in a rearward direction toward the headboard of the bed while the back deck of the bed, upon which the person's back is supported, is being elevated whereby as the person is effectively moved from a supine position to a sitting position at which the person's back may be disposed at any predeterminedly selected comfortable angle, such as, for example, 45°, by means of the elevated back deck, the upper, free end or rear edge portion of the back deck of the bed effectively remains within a vertical plane corresponding to the plane within which the head end frame member of the underlying bed frame, as well as the headboard of the bed, is disposed, such that the person, now sitting in a partial upright position within the bed, can easily and readily access items which may be disposed upon a nightstand located adjacent to the powered bed.

OVERALL OBJECTIVES OF THE PRESENT INVENTION

An overall objective of the present invention is to provide a new and improved powered bed. An additional overall objective of the present invention is to provide a new and improved powered bed which comprises a back deck, a lumbar deck, a pair of seat decks, a thigh deck, a leg deck, and a headboard. Another overall objective of the present invention is to provide a new and improved powered bed which comprises a back deck, a lumbar deck, a pair of seat decks, a thigh deck, a leg deck, a headboard, and a sliding mechanism upon which the back deck, the lumbar deck, the pair of seat decks, the thigh deck, and the leg deck are disposed. Still another overall objective of the present invention is to provide a new and improved powered bed which comprises a back deck, a lumbar deck, a pair of seat decks, a thigh deck, a leg deck, a headboard, and a sliding mechanism upon which the back deck, the lumbar deck, the pair of seat decks, the thigh deck, and the leg deck are disposed, wherein the sliding mechanism is adapted to be moved in a rearward direction toward the headboard of the bed when the back deck of the bed, upon which the person's back is supported, is being elevated.

Yet another overall objective of the present invention is to provide a new and improved powered bed which comprises a back deck, a lumbar deck, a pair of seat decks, a thigh deck, a leg deck, a headboard, and a sliding mechanism upon which the back deck, the lumbar deck, the pair of seat decks, the thigh deck, and the leg deck are disposed, wherein the sliding mechanism is adapted to be moved in a rearward direction toward the headboard of the bed when the back deck of the bed, upon which the person's back is supported, is being elevated, whereby as the person is effectively moved from a supine position to a sitting position at which the person's back may be disposed at any predeterminedly selected comfortable angle, such as, for example, 45°, by means of the elevated back deck, the upper, free end or rear edge portion of the back deck of the bed effectively remains within a vertical plane corresponding to the plane within which the head end frame member of the underlying bed frame, as well as the headboard of the bed, is disposed. A further overall objective of the present invention is to provide a new and improved powered bed which comprises a back deck, a lumbar deck, a pair of seat decks, a thigh deck, a leg deck, a headboard, and a sliding mechanism upon which the back deck, the lumbar deck, the pair of seat decks, the thigh deck, and the leg deck are disposed, wherein the sliding mechanism is adapted to be moved in a rearward direction toward the headboard of the bed while the back deck of the bed, upon which the person's back is supported, is being elevated whereby as the person is effectively moved from a supine position to a sitting position at which the person's back may be disposed at any predeterminedly selected comfortable angle, such as, for example, 45°, by means of the elevated back deck, the upper free end or rear edge portion of the back deck of the bed effectively remains within a vertical plane corresponding to the plane within which the head end frame member of the underlying bed frame, as well as the headboard of the bed, is disposed, such that the person, now sitting in a partial upright position within the bed, can easily and readily access items which may be disposed upon a nightstand located adjacent to the powered bed.

SUMMARY OF THE INVENTION

In accordance with the principles and teachings of the present invention, there has been developed a new and improved powered bed which comprises an underlying bed frame, a plurality of movable decks, such as, for example, a back deck, a lumbar deck, a thigh deck, and a leg deck, as well as a headboard which is fixedly secured to a head end frame member of the underlying bed frame, and a pair of seat decks which are interposed between the lumbar deck and the thigh deck. Still further, the back deck, the lumbar deck, the pair of seat decks, the thigh deck, and the foot deck are mounted upon a sliding mechanism which is slidably mounted upon the underlying bed frame. A back deck linear actuator is operatively connected to a back driving tube such that when the back deck linear actuator is actuated so as to move its telescopic tube from a retracted position to an extended position, the telescopic tube of the back deck linear actuator moves the back driving tube which has its opposite ends connected to a pair of laterally spaced link members which have their lower end portions pivotally connected to laterally spaced portions of the underlying bed frame, while the opposite end portions of the pair of laterally spaced link members are pivotally connected to mid-section portions of a pair of laterally spaced back deck supporting members.

Lower end portions of the pair of laterally spaced back deck supporting members are pivotally connected to the sliding mechanism, while upper end portions of the pair of laterally spaced back deck supporting members are provided with rollers or wheels which are adapted to roll or scroll along the back deck member as the back deck member is elevated from a substantially horizontal position to an elevated position. Since the lower end portions of the pair of laterally spaced back deck supporting members are pivotally connected to the sliding mechanism, then it will be appreciated that as the pair of laterally spaced back deck supporting members are elevated, so as to, in turn, elevate the back deck, the pair of laterally spaced back deck supporting members will cause the sliding mechanism to move toward the headboard. In this manner, the upper free end or rear edge portion of the back deck will always remain disposed within the vertical plane within which the head end frame member of the underlying bed frame is disposed. Accordingly, the head and shoulders of the person now sitting in the bed with his/her back in a reclined position, will nevertheless be close to the nightstand, disposed adjacent to the bed, such that items, disposed upon the nightstand, can be easily and readily accessed by the person sitting in the bed. Mechanisms similar to those for actuating the back deck are provided for actuating the foot deck, and still further, both the underlying bed frame and the sliding mechanism are capable of being folded in half so as to render transportation and storage of the powered bed relatively easy to achieve or accomplish. More particularly, the underlying bed frame comprises left and right longitudinally extending side frame members which, in turn, comprise forward and rearward half bed frame members which are pivotally connected to a connecting block, while the sliding mechanism likewise comprises left and right longitudinally extending side frame members which, in turn, comprise forward and rearward half frame members which are pivotally connected together by folding hinge members. When the sliding mechanism is disposed at a predeterminedly defined position relative to the underlying bed frame, the folding hinge members of the sliding mechanism will effectively be aligned with the connecting block of the underlying bed frame such that the entire bed assembly can be folded in half so as to render transportation and storage of the powered bed relatively easy to achieve or accomplish.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
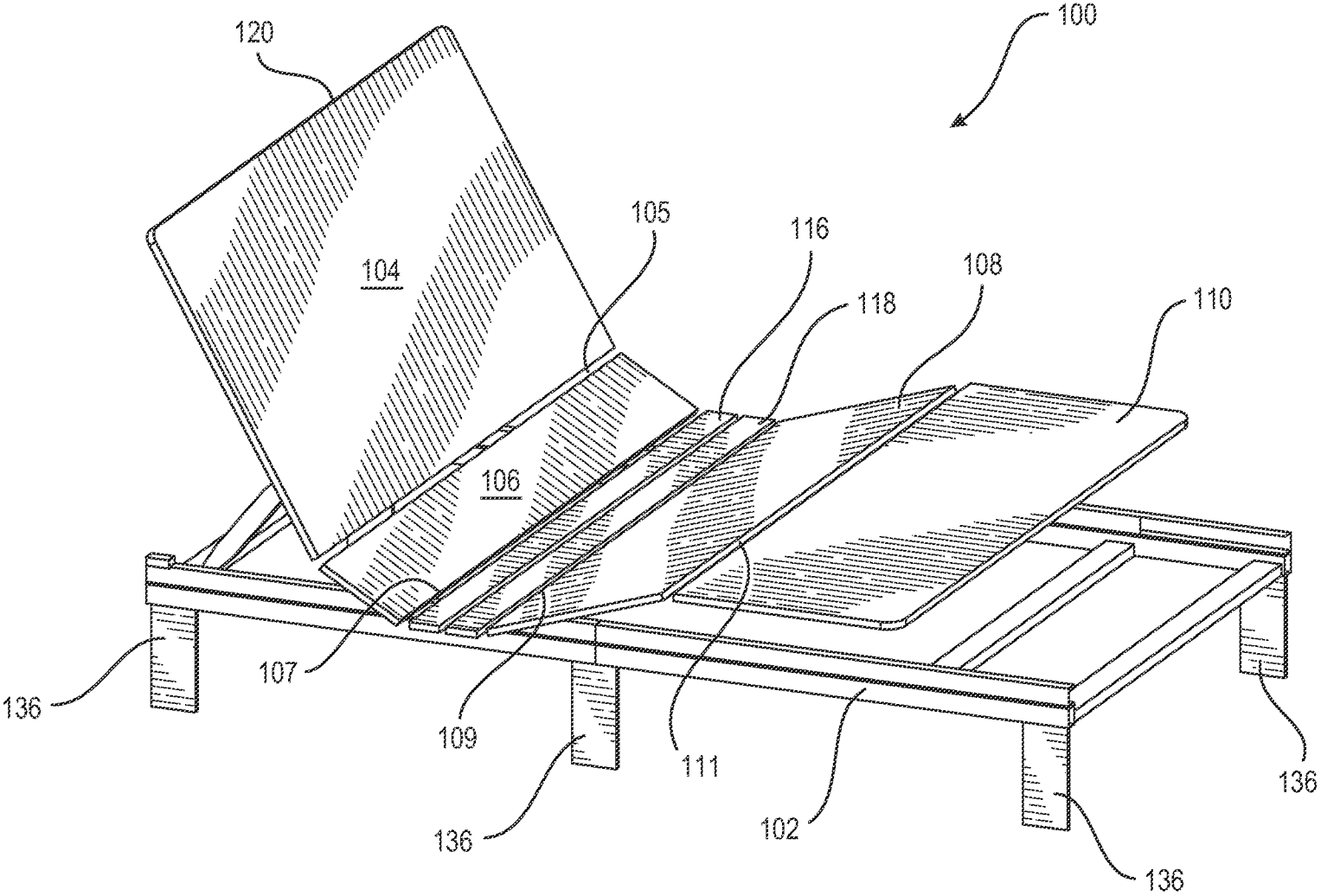
FIG. 1 is a schematic right side, foot end, perspective view of a new and improved zero gap foldable powered bed as constructed in accordance with the principles and teachings of the present invention.
Figure 2:
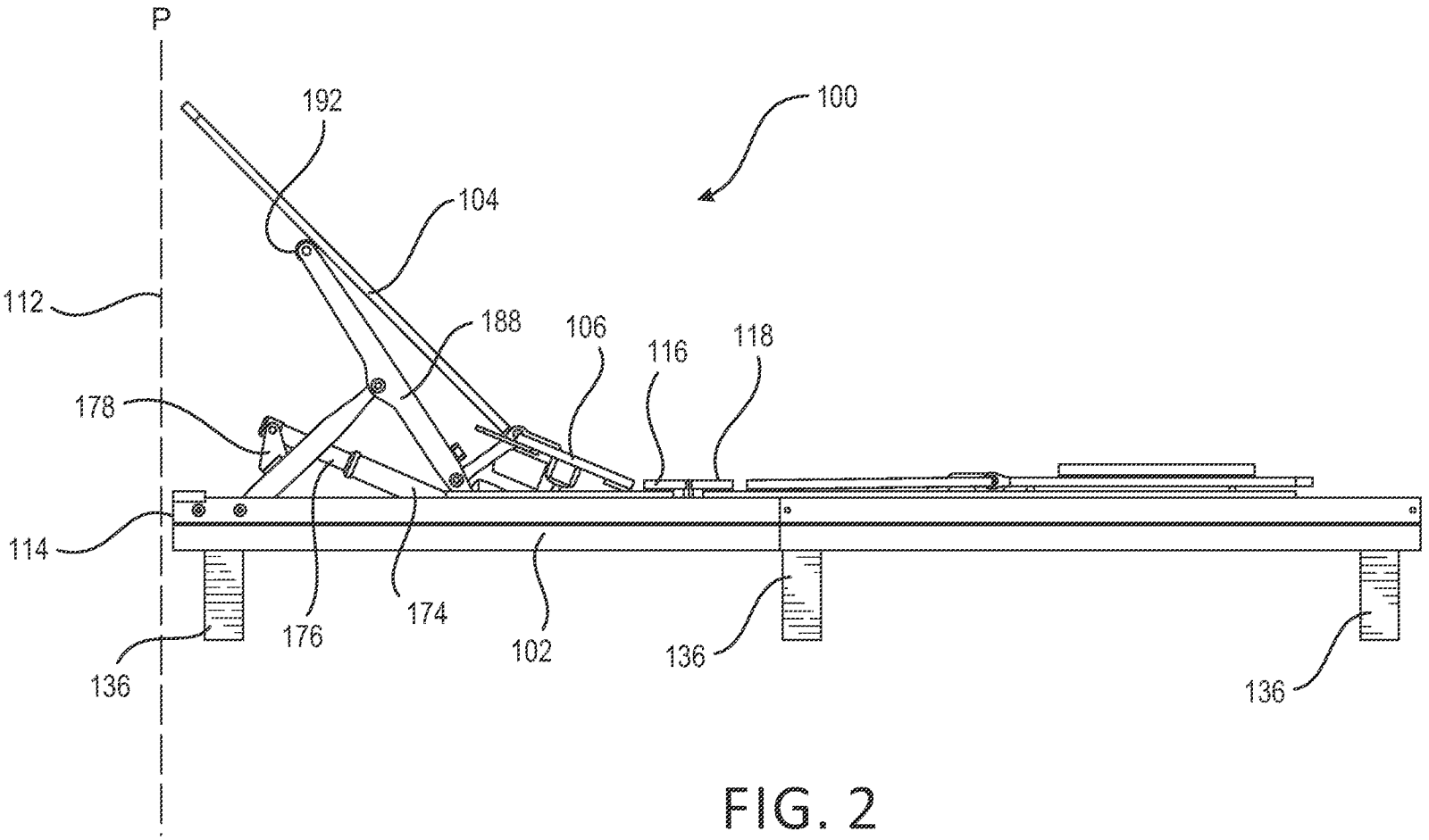
FIG. 2 is a schematic right side, elevational view of the zero gap foldable powered bed as illustrated within FIG. 1 schematically illustrating how the upper free end edge portion of the back deck remains within the vertical plane P as the back deck is elevated from its fully lowered position to an elevated position having an angle of, for example, 45°.
Figure 3:
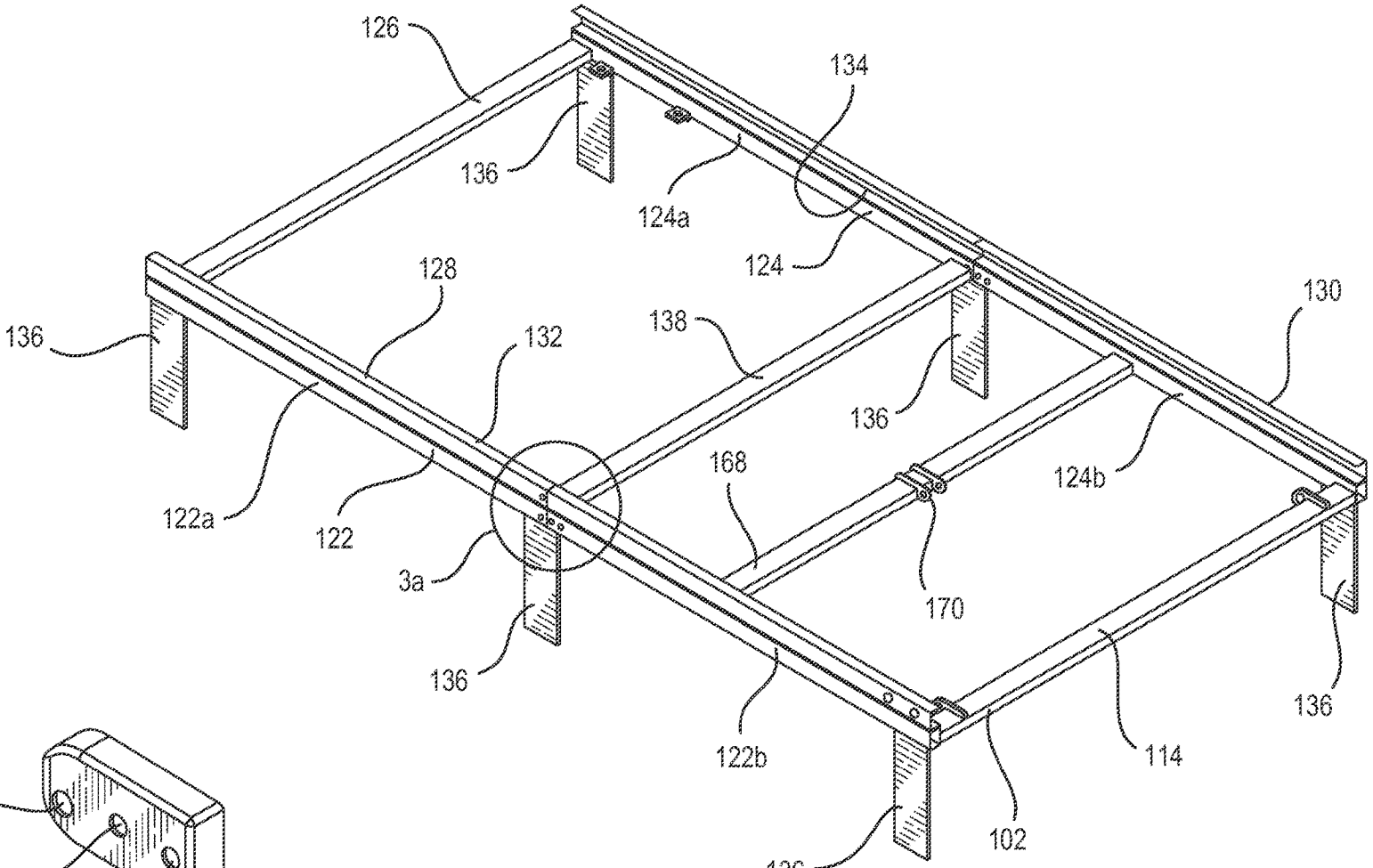
FIG. 3 is schematic left side, head end, perspective view of a new and improved zero gap foldable powered bed as constructed in accordance with the principles and teachings of the present invention wherein the detailed structure of the underlying bed frame is disclosed.
Figure 3A:
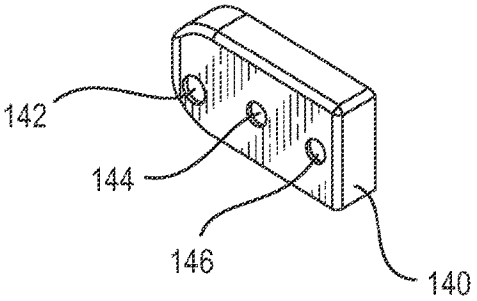
FIG. 3*a* is an enlarged detailed view of the encircled region 3*a* illustrated within FIG. 3.

Referring now to the drawings, a zero gap foldable powered bed has been developed in accordance with the principles and teachings of the present invention, and is generally disclosed within FIGS. 1 and 2 by means of reference number 100. More particularly, it is seen that the zero gap foldable powered bed comprises an underlying bed frame 102, a plurality of movable decks, such as, for example, a back deck 104, a lumbar deck 106, a thigh deck 108, and a leg deck 110, as well as a headboard 112 which is fixedly secured to a head end frame member 114 of the underlying bed frame 102, as can best be seen, for example, within FIG. 3, and a pair of seat decks 116,118 which are interposed between the lumbar deck 106 and the thigh deck 108. The headboard 112 is schematically illustrated within FIG. 2 so as to be fixedly disposed within a vertical plane P, and as will be more fully disclosed hereinafter, when the back deck 104 is raised or elevated, as disclosed within FIG. 2, the upper free edge portion 120 of the back deck 104, will always be maintained at a position which is immediately adjacent to the headboard 112 disposed within the vertical plane P such that the head and shoulders of the person now sitting in the bed with his/her back in a reclined position resting upon the raised or elevated back deck 104, will nevertheless be close to a nightstand, disposed adjacent to the bed, such that items, disposed upon the nightstand, can be easily and readily accessed by the person sitting in the bed. It is also noted that the various deck members 104,106, 108, and 110 are pivotally connected to each other in a serial manner, as well as to the seat decks 116,118, by means of suitable hinge mechanisms as shown at 105, 107,109, and 111.

With reference now being made to FIGS. 3 and 3*a*-3*e*, the structure of the underlying bed frame 102 will now be more fully disclosed. More particularly, it is seen that the underlying bed frame 102 has a substantially rectangular configuration and is seen to comprise a left side, longitudinally extending side frame member 122, an oppositely disposed right side, longitudinally extending side frame member 124, the transversely oriented head end frame member 114, and an oppositely disposed, transversely oriented foot end frame member 126. In addition, it is seen that each one of the left and right longitudinally extending side frame members 122,124 is respectively provided with left and right side longitudinally extending track members 128,130 which are respectively fixedly secured atop the left and right side longitudinally extending side frame member 122,124 and have hollow, longitudinally extending internal portions defined upon the inner sides thereof so as to effectively define longitudinally extending tracks 132,134 which are disposed opposite each other and effectively face each other, only track 134 being truly visible within FIG. 3. In addition, the underlying bed frame 102 is supported by means of a plurality of leg members 136 which are disposed at the four corners of the rectangular bed frame 102 as well as at central or midway locations along the pair of oppositely disposed longitudinally extending side frame members 122,124.

Figure 3B:
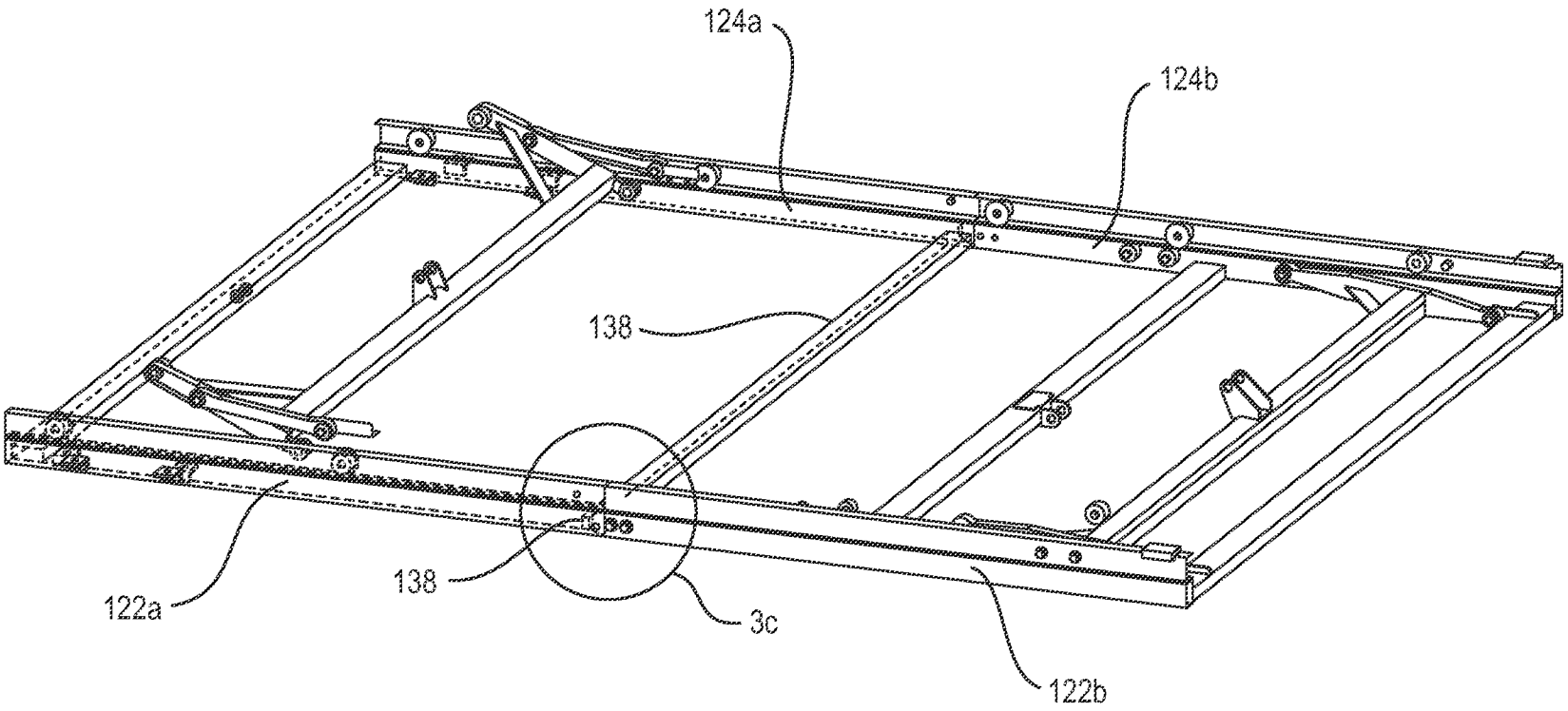
FIG. 3*b* is a view similar to that of FIG. 3 showing, however, more detailed structure of the overall underlying frame and sliding mechanism, some portions of which are effectively illustrated as being transparent for clarity purposes.
Figure 3D:
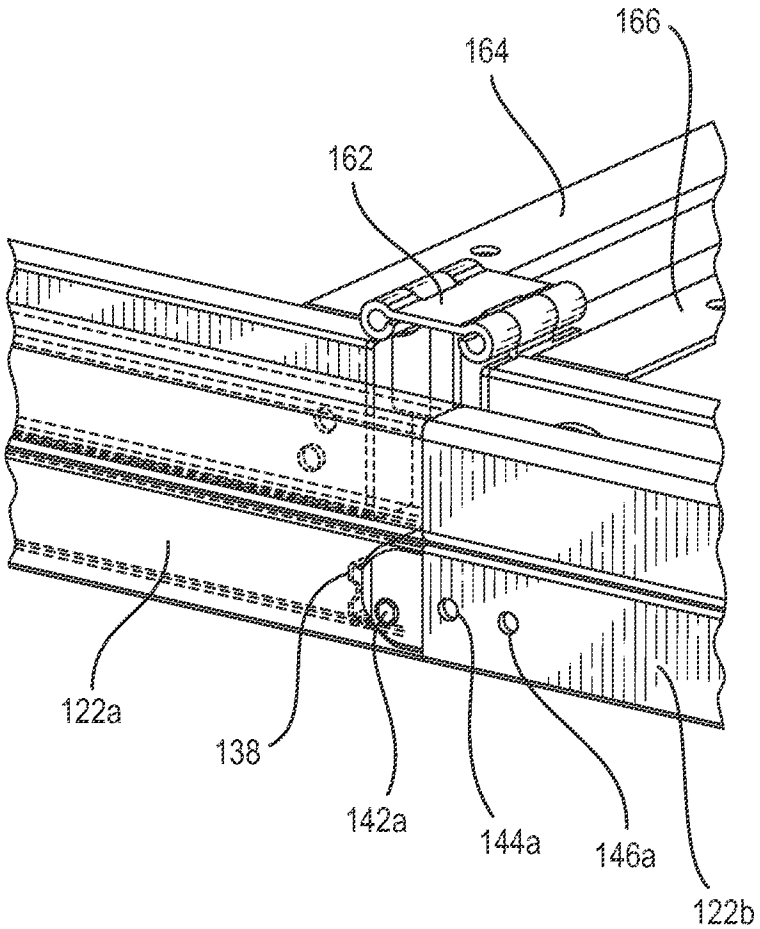
FIG. 3*d* is an enlarged detailed view similar to that of FIG. 3*c* before the connecting blocks of FIG. 3*a* are connected to the longitudinally extending half section frame members.
Figure 3C:
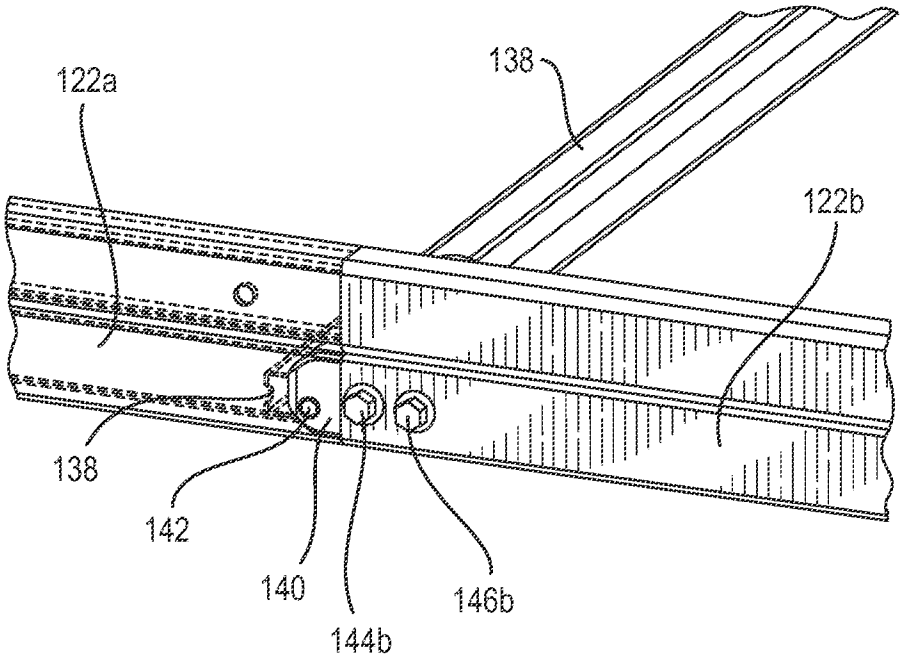
FIG. 3*c* is an enlarged detailed view of the region noted as 3*c* in FIG. 3*b* so as to provide additional clarity to the connections of the connecting blocks of FIG. 3*a* and the longitudinally extending half-section frame members.

Furthermore, each one of the left and right longitudinally extending side frame members 122,124 comprises longitudinally extending half section frame members 122*a*,122*b*, 124*a*,124*b*, and opposite ends of a transversely extending cross beam member 138 are fixedly connected to internal surface portions of the oppositely disposed longitudinally extending half section frame members 122*a*,124*a*, by any suitable means, such as, for example, welding, as can best be seen in FIGS. 3*b*-3*d*. In addition, a connecting block 140, as is clearly shown in FIG. 3*a*, and only one of which is visible in FIGS. 3*b*-3*d*, is adapted to be fixedly disposed within, and effectively interconnects, the longitudinally extending half section frame members 122*a*,122*b*,124*a*,124*b* together. More particularly, as can be appreciated from FIG. 3*a*, it is seen that the connecting block 140 is provided with three apertures, holes, or through bores 142,144,146. In addition, as can be appreciated from FIGS. 3*b*-3*d*, the rectangular end of each connecting block 140 is adapted to be inserted into the longitudinally extending half-section frame members 122*b*,124*b* while the oppositely disposed rounded end of each connecting block 140 is adapted to be inserted into the longitudinally extending half-section frame members 122*a*, 124*a*.

Figure 3E:
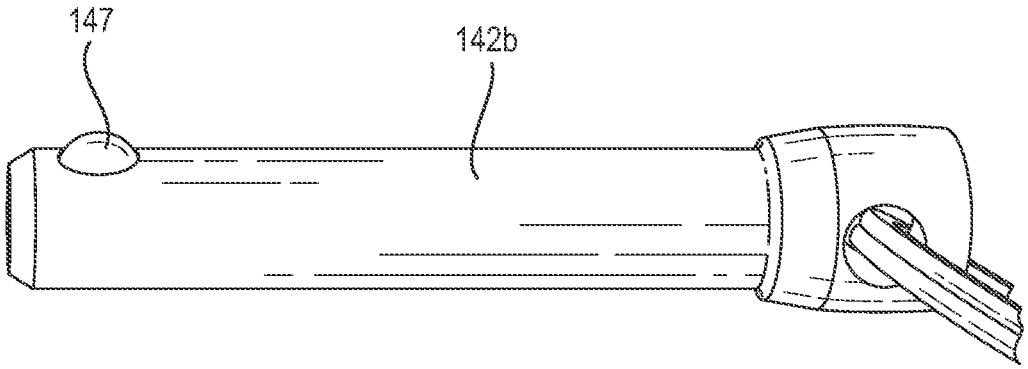
FIG. 3*e* is a schematic view of a quick latch pin fastener utilized to fix the round end portions of the connecting blocks to the longitudinally extending half section frame members.

Still further, as can best be appreciated from FIG. 3*d*, longitudinally extending half-section frame members 122*a*, 124*a* are provided with apertures or bores 142*a*, while longitudinally extending half-section frame members 122*a*,

124*b* are provided with apertures or bores 144*a* and 146*a*. As can be further appreciated from FIG. 3*c*, suitable fasteners, such as, for example, screws or bolts 144*b*,146*b* are then adapted to pass through apertures or bores 144*a*,146*a* defined within the longitudinally extending half-sections 122*b*,124*b* and into apertures 144,146 defined within the connecting block 140. In turn, a quick latch pin 142*b*, as shown in FIG. 3*e*, is adapted to be inserted through aperture 142*a* defined within longitudinal half-section frame member 122*a* and aperture 142 defined within the connecting block 140. The quick latch pin 142*b* is provided with a spring-biased detent 147 near its distal end such that as the quick latch pin 142*b* is inserted into the through bore 142 defined within the connecting block 140, the detent 147 will be forced inwardly against its spring-biasing force, and once the detent 147 clears the other side of the through bore 142 defined within the connecting block 140, the detent 147 will return to its normal, outward disposition as illustrated within FIG. 3*e*, thereby locking or connecting the longitudinally extending half section frame members 122*a*,124*a* to the connecting blocks 140. In addition, if the quick latch pins 142*b* are removed from the longitudinally extending half sections 122*a*,124*a* and the connecting blocks 140, then the longitudinally extending half section frame members 122*a*, 124*a* will be free to be disengaged from the connecting blocks 140 and effectively be able to be pivoted around a horizontal axis parallel to the horizontal axis extending through or defined by the apertures or bores 142 defined within the connecting blocks 140. In this manner, the longitudinally extending section frame members 122*a*,124*a* will be able to be disposed atop the longitudinally extending section frame members 122*b*,124*b* such that the underlying bed frame 102 is capable of being folded in half.

Figure 4:
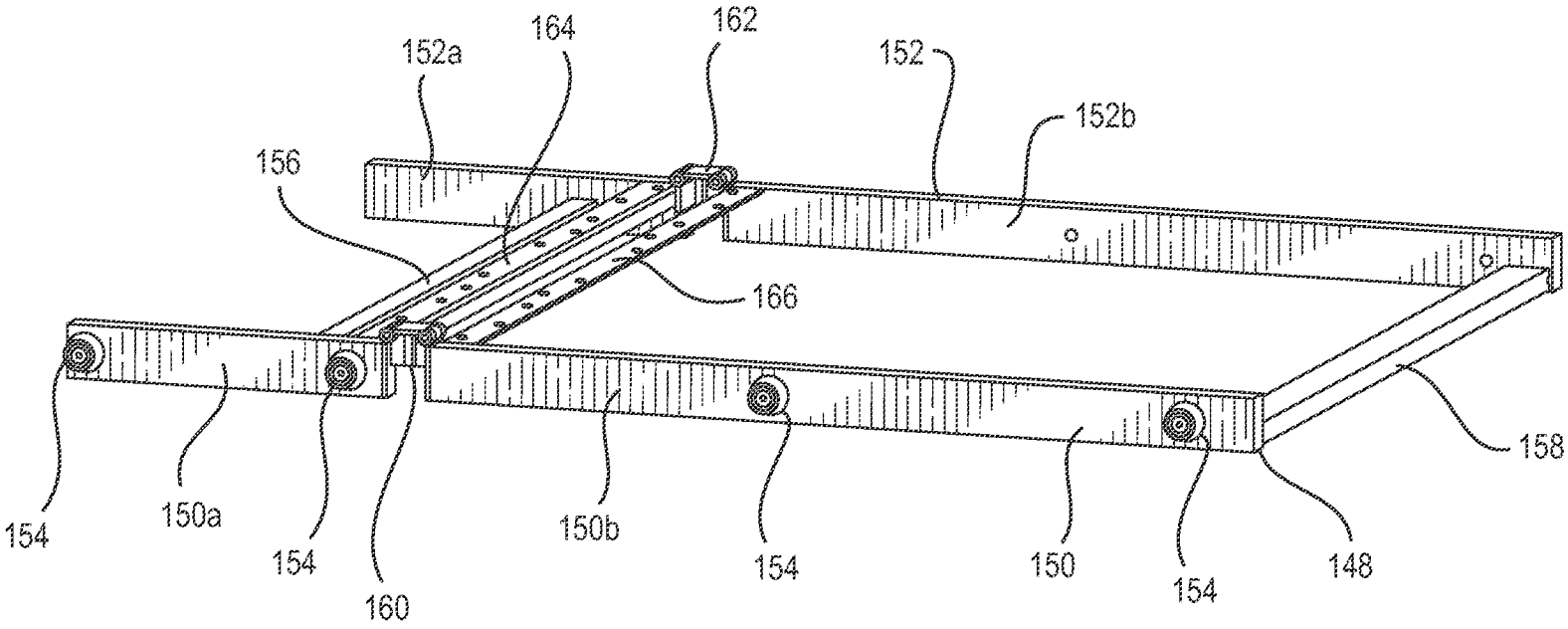
FIG. 4 is a perspective view of a sliding mechanism which is adapted to be slidably mounted within the track members disposed atop the left and right longitudinally extending side frame members as illustrated within FIG. 3.
Figure 5:
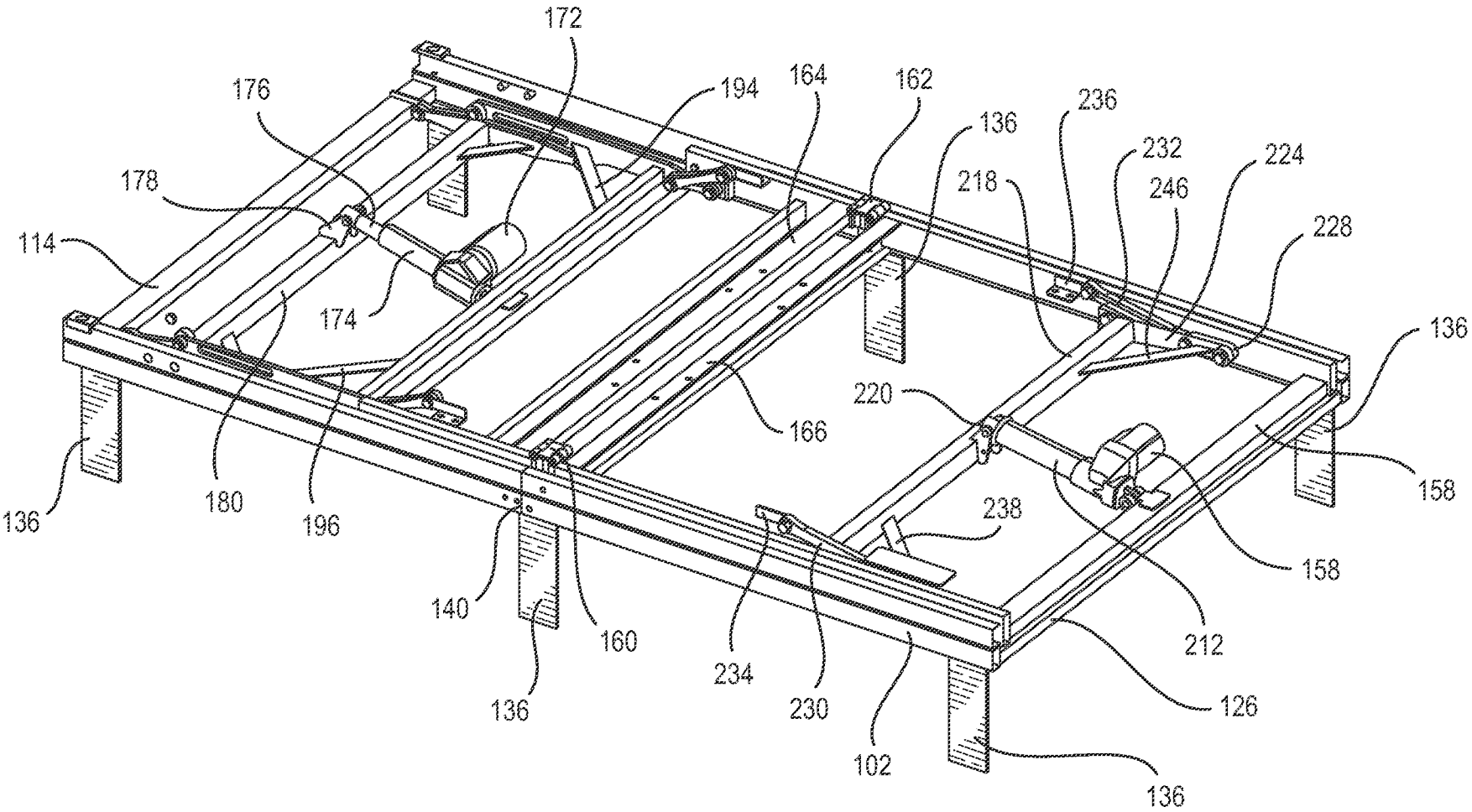
FIG. 5 is a perspective view of the underlying bed frame, as shown in FIG. 3, having the sliding mechanism, as shown in FIG. 4, mounted thereon.

With reference now being made to FIGS. 4 and 5, a sliding mechanism, the complete purpose and operation of which will be more fully discussed hereinafter, is disclosed and is designated by the reference character 148. More particularly, the sliding mechanism 148 is adapted to be slidably disposed within the pair of oppositely disposed track members 132,134 affixed to the underlying bed frame 102, and it is seen that the sliding mechanism 148 comprises a pair of oppositely disposed, longitudinally extending sliding members 150,152, wherein outer or external surface portions of the pair of oppositely disposed, longitudinally extending sliding members 150,152 are provided with a plurality of longitudinally spaced rollers or wheels 154, only the rollers or wheels 154 disposed upon the longitudinally extending sliding member 150 being visible. In addition, the sliding mechanism 148 is provided with a first transversely oriented cross beam 156 which interconnects the pair of oppositely disposed, longitudinally extending sliding members 150,152 at a position disposed toward the head end frame member 114, so as to structurally stabilize that end of the sliding mechanism 148, while a second transversely oriented cross beam 158 interconnects the pair of oppositely disposed, longitudinally extending sliding members 150,152 at a position adjacent to the foot end frame member 126 so as to similarly stabilize that end of the sliding mechanism 148.

In addition, it is seen that each one of the pair of oppositely disposed, longitudinally extending sliding members 150,152 comprises sections 150*a*,150*b* and 152*a*,152*b* which are respectively connected together by means of a pair of oppositely disposed folding hinge mechanisms 160, 162. Accordingly, as can best be appreciated from FIG. 5, when the sliding mechanism 148 is disposed at its default position, that is, when the second cross beam 158 is disposed atop, or coincides with, the foot end frame member 126, which means that all of the deck members 104,106,108,110 are disposed at their horizontal or flat or non-elevated positions, the hinge mechanisms 160,162 of the sliding mechanism 148 will be vertically aligned with the connecting blocks 140 of the underlying frame member 102 such that the zero gap powered folding bed 100 can in fact be folded in half so as to facilitate transportation or storage of the zero gap powered folding bed 100. This is accomplished by means of removing the quick latch pins 142*b* from the apertures or bores 142*a* within the longitudinally extending half section frame members 122*a*,124*a*, as has been noted hereinbefore, along with the provision of the hinge mechanisms 160,162 permitting the folding of the sliding mechanism sections 150*a*,150*b*,152*a*,152*b* along with the folding of the longitudinally extending half section frame members 122*a*,124*a*. Lastly, it is seen that a pair of transversely oriented seat deck connecting plates 164,166 have their opposite ends affixed to upper edge portions of the pair of oppositely disposed, longitudinally extending sliding members 150,152 of the sliding mechanism 148 and upon opposite sides of the hinge mechanisms 160,162 such that the pair of seat decks 116,118 can be fixedly attached to the seat deck connecting plates 164,166 and to the sliding mechanism 148.

Continuing further, and with reference now being made to FIGS. 6 and 7, a description of the back deck lifting mechanism will now be described. More particularly, it is seen that the underlying bed frame 102 also comprises a transversely extending back deck linear actuator support beam 168 which is provided with a first clevis connector 170 to which the motor end 172 of a back deck linear actuator 174 can be connected, while a telescopic tube end 176 of the back deck linear actuator 174 is connected to a second clevis connector 178 which is mounted upon a transversely oriented back deck driving tube 180. As can further be appreciated from FIGS. 6 and 7, opposite ends of the back deck driving tube 180 are connected to a pair of link members 182,184 which have first end portions thereof pivotally connected to the head end frame member 114, while second opposite end portions of the link members 182,184 are respectively pivotally connected to central portions of a pair of laterally spaced back deck supporting bars 186,188. In turn, first end portions of the pair of laterally spaced back deck supporting bars 186,188 are respectively connected to sections 150*a*,152*a* of the sliding mechanism 148, while oppositely disposed free end portions of the pair of laterally spaced back deck supporting bars 186,188 are provided with wheels or rollers 190,192 which are adapted to roll or scroll along the rear or undersurface portion of the back deck 104 as the back deck 104 is moved between elevated and lowered positions.

Figure 6:
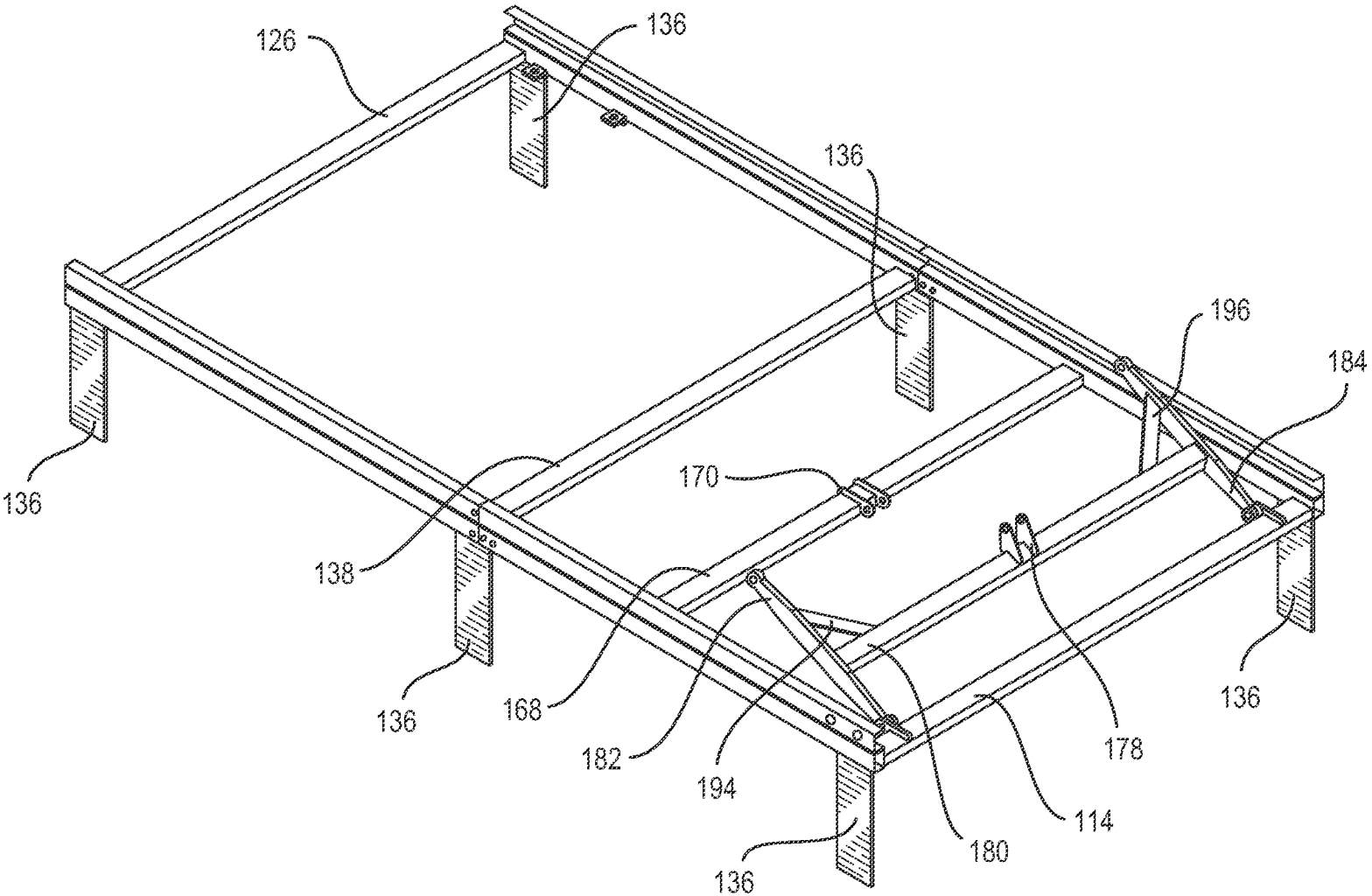
FIG. 6 is a schematic view similar to that of FIG. 3 showing, however, the provision of the transversely oriented back deck driving tube and the laterally spaced link members connected to opposite ends of the back deck driving tube.

As can further be appreciated from FIG. 6, a first pair of strengthening bars 194,196 are respectively fixedly connected between the pair of laterally spaced link members 182,184 and the back deck driving tube 180 such that the three structural members, that is, the back deck driving tube 180, the link members 182,184, and the strengthening bars 194,196 effectively form first triangular structural assemblies which provide strength and stability to the first structural assemblies as the first structural assemblies undergo movements between elevated and lowered positions of the back deck 104. Continuing further, in order to provide even more or enhanced strength and stability to the overall back deck actuation system, a transversely oriented synchronization bar 198 has its oppositely disposed end portions fixedly connected to the oppositely disposed back deck supporting bars 186,188 at locations adjacent to those ends of the back deck supporting bars 186,188 which are connected to the sections 150*a*,152*a* of the sliding mechanism 148, while a second pair of strengthening bars 200,202 are respectively fixedly connected between mid-points of the back deck supporting bars 186,188 to the synchronization bar 198 such that the three structural members, that is, the back deck supporting bars 186,188, the synchronization bar 198, and the second pair of strengthening bars 200,202 effectively form second triangular structural assemblies which provide additional or enhanced strength and stability to the second structural assemblies as the second structural assemblies undergo movements between elevated and lowered positions of the back deck 104. In order to complete the back deck and lumbar deck assembly, it is lastly seen that a pair of lumbar deck connecting bars 204,206 are respectively pivotally attached to the back deck supporting bars 186,188, and, in turn, a pair of lumbar deck securing plates 208,210 are respectively pivotally attached to the pair of lumbar deck connecting bars 204,206 such that opposite sides or ends of the lumbar deck 106 may be fixedly secured to the lumbar deck securing plates 208,210.

Figure 7:
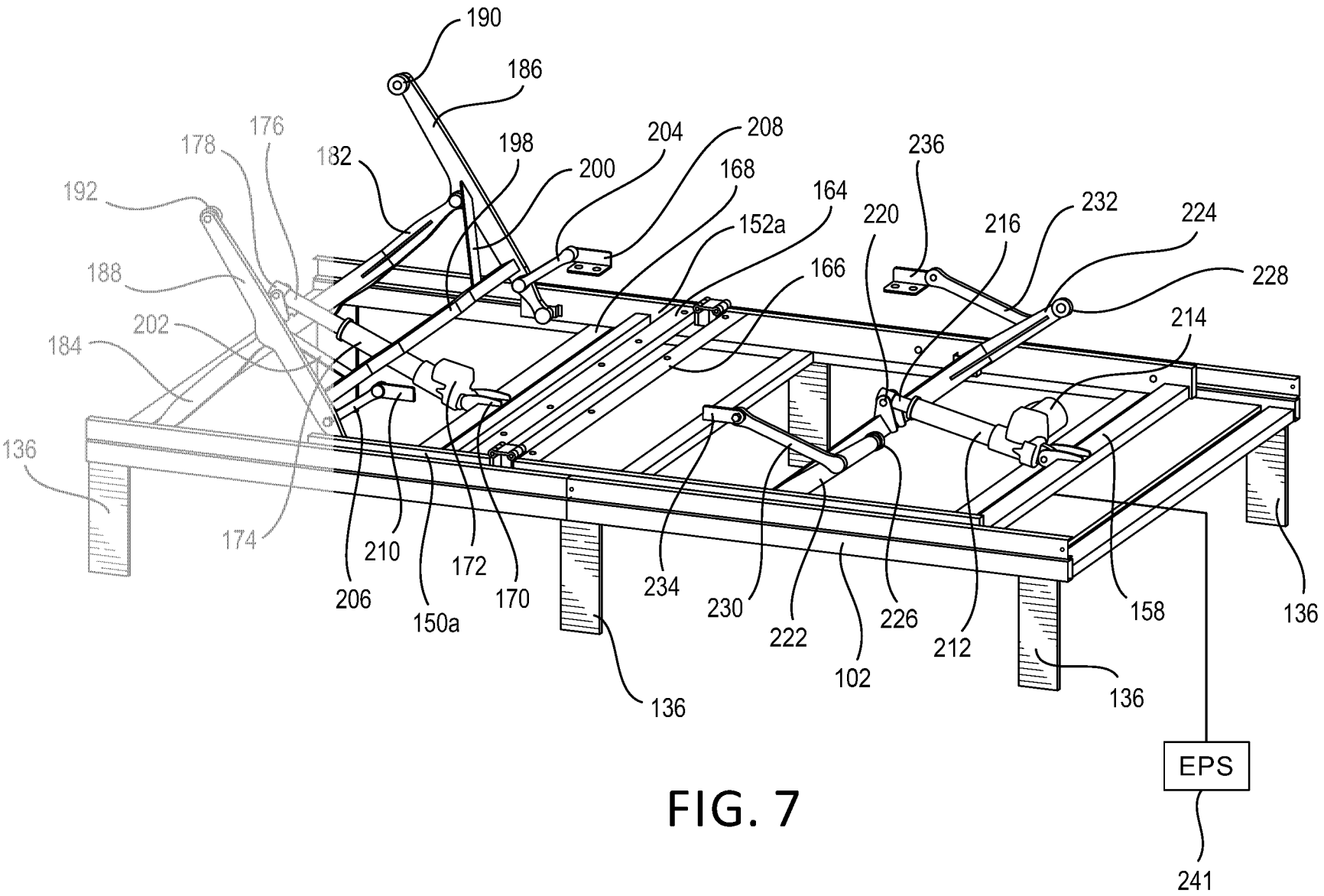
FIG. 7 is a schematic view similar to that of FIG. 6 showing, however, the additional connections of the laterally spaced link members to a pair of laterally spaced back deck supporting bars, as well as some of the system components with greater clarity.

With reference continuing to be made to FIG. 7, the leg deck lifting mechanism will now be described. In a manner similar to that disclosed and discussed hereinbefore in connection with the back deck lifting mechanism, it is seen that the leg deck lifting mechanism comprises a leg deck linear actuator 212 wherein the motor end 214 of the leg deck linear actuator 212 is pivotally secured to the second transversely oriented cross beam 158 of the sliding mechanism 148, while the telescopic tube 216 of the leg deck linear actuator 212 is pivotally connected to a transversely oriented leg driving tube 218 by means of a clevis connector 220. Opposite ends of the transversely oriented leg driving tube 218 are respectively connected to a pair of transversely spaced leg deck supporting bars 222,224 which have wheels or rollers 226,228 rotatably mounted upon their free end portions so as to be capable of rolling along the undersurface or rear portion of the leg deck 110 as the leg deck 110 is moved between elevated and lowered positions. In a manner similar to the back deck lifting mechanism, it is further seen that a pair of thigh connecting bars 230,232 are respectively connected to the leg deck supporting bars 222,224, and, in turn, a pair of thigh deck securing plates 234,236 are respectively connected to the thigh connecting bars 230,232 for permitting the thigh deck to be fixedly secured to the thigh deck securing plates 234,236. Lastly, as can best be seen in FIG. 5, a third pair of strengthening bars 238,240 are respectively fixedly connected between the pair of leg deck supporting bars 222,224 and the leg deck driving tube 218 such that the three structural members, that is, the leg deck driving tube 218, the leg deck supporting bars 222,224, and the strengthening bars 238,240 effectively form third triangular structural assemblies which provide strength and stability to the third structural assemblies as the third structural assemblies undergo movements between elevated and lowered positions of the leg deck 110 in accordance with the extension or contraction of the leg feck linear actuator 212. An electrical power source (EPS) 241 is schematically shown as being electrically connected to the sliding assembly so as to supply electrical power to the motors 172,214 of the back deck and leg deck linear actuators 174,212.

Figure 8:
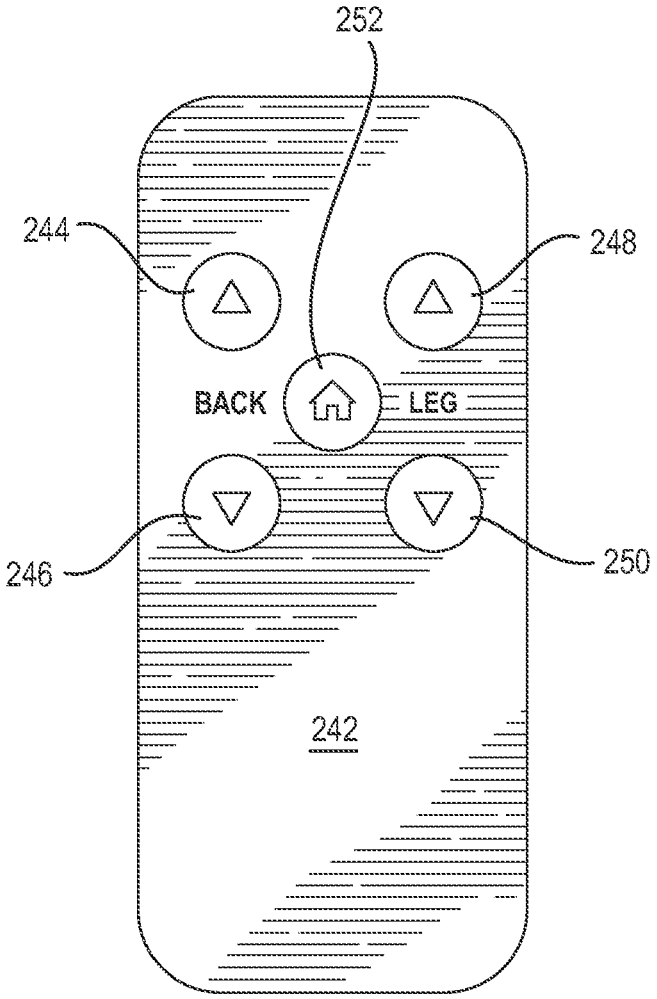
FIG. 8 is a schematic view of an exemplary remote control device which can be utilized to control the back and leg deck lifting mechanisms between a multitude of elevated and lowered positions as well as a home position at which the back and leg lifting mechanisms will be returned to their default positions at which all deck members are moved to their horizontal, flat, or non-elevated positions.

With reference lastly being made to FIG. 8, an exemplary embodiment of a suitable remote control unit 242 is disclosed so as to control the actuation of the back and leg linear actuators 174,212 in order to respectively control the elevation and lowering of the back and lumbar decks 104, 106 and the leg and thigh decks 110,108. More particularly, the remote control unit 242 may comprise a back UP button 244, a back DOWN button 246, a leg UP button 248, and a leg DOWN button 250. In addition, the remote control unit 242 comprises a HOME button 252 which, when depressed, actuates the back and leg motors 172,214 so as to retract the back and leg telescopic tubes 176,216 of the back and leg linear actuators 174,212 such that all of the decks 104,106, 108,110 are moved or returned to their original, non-elevated default positions at which they are horizontal, flat, and co-planar with the pair of seat decks 116,118.

Having described all of the structural components comprising the new and improved zero gap powered folding bed 100 of the present invention, a brief description of the operation of the same will now be provided. More particularly, when it is desired to elevate the back deck 104, as well as the lumbar deck 106 operatively connected thereto, the person lying on the bed 100 will depress the back deck UP button 244 upon the remote control unit 242, it being understood that the remote control unit 242 can either be hard-wired to the back and lifting mechanisms of the bed 100 or operatively connected to the back and leg lifting mechanisms by means of well-known wireless technology. Accordingly, when the back deck UP button 244 is depressed, a signal will be sent to the back deck linear actuator 174 so as to actuate the same so as to move its telescopic tube 176 from a retracted position to an extended position, the telescopic tube 176 of the back deck linear actuator 174 moves the back driving tube 180 which has its opposite ends connected to the pair of laterally spaced link members 182,184 which have their first end portions pivotally connected to the end frame member 114 of the underlying bed frame 102, while the opposite end portions of the pair of laterally spaced link members 182,184 are pivotally connected to the mid-section portions of the pair of laterally spaced back deck supporting members 186,188.

Since the first end portions of the pair of laterally spaced back deck supporting members 186,188 are pivotally connected to the sliding mechanism 148, then it is clear that as the pair of laterally spaced back deck supporting members 186188 are elevated, so as to, in turn, elevate the back deck 104, the pair of laterally spaced back deck supporting members 186,188 will cause the sliding mechanism 148 to move toward the headboard 112. In this manner, the upper free end edge portion 120 of the back deck 104 will always remain disposed within the vertical plane P within which the head end frame member 114 of the underlying bed frame 102 is disposed as can be appreciated from FIG. 2. Accordingly, the head and shoulders of the person now sitting in the bed with his/her back in a reclined position, will nevertheless be close to the nightstand, disposed adjacent to the bed, such that items, disposed upon the nightstand, can be easily and readily accessed by the person sitting in the bed. Depression of the back deck DOWN button 246 upon the remote control unit 242 will likewise send signals to the back deck linear actuator 174 such that the back and lumbar deck members 104,106 will be lowered while depression of the leg deck UP and DOWN buttons 248,250 upon the remote control unit 242 will similarly control the leg deck linear actuator 212 of the leg lifting mechanism as has been disclosed hereinbefore. As has also been noted hereinbefore, when ail of the deck members are disposed at their original, default positions, wherein all of the deck members 104,106, 108,110 are flat, disposed horizontally, and are co-planar with the seat decks 116,118, the hinge connectors 160,162 of the sliding mechanism 148 will be vertically aligned with the connecting block 140 so as to permit the zero gap foldable powered bed 100 to be folded in half so as to facilitate transportation and/or storage thereof.

Obviously, many variations and modifications of the present invention are possible in light of the above teachings. It is therefore to be understood that within the scope of the appended claims, the present invention may be practiced otherwise than as specifically described herein.

What is claimed and desired to be protected by Letters Patent is:

1. A zero gap foldable powered bed, comprising: a bed frame; a head end frame member of said bed frame defining a vertically oriented plane; a sliding mechanism slidably mounted upon said bed frame; a back deck operatively connected to said sliding mechanism and having a free, unattached end portion which is disposed adjacent to said vertically oriented plane defined by said head end frame member of said bed frame; a linkage system operatively connecting said bed frame, said back deck, and said sliding mechanism together; and a back deck actuator, mounted upon said bed frame and operatively connected to said back deck and said linkage system connecting said bed frame, said back deck, and said sliding mechanism together, configured to cause said back deck to undergo movements between elevated and lowered positions, as a result of which said sliding mechanism is moved along said bed frame in response to said movements of said back deck between said raised and lowered positions, such that regardless of the elevation of said back deck to any predetermined elevational level by said back deck actuator, said free, unattached end portion of said back deck will always remain disposed adjacent and disposed a fixed distance away from said vertically oriented plane, defined by said head end frame member of said bed, as a result of said sliding mechanism moving along said bed frame as said back deck is being elevated and lowered, whereby shoulder and back portions of a person sitting upon said bed will remain at a substantially same position relative to said vertically oriented plane defined by said head end frame member whereby the person can readily access items disposed adjacent to said vertically oriented plane defined by said head frame member.

2. The bed as set forth in claim 1, wherein:

said bed frame additionally comprises a foot end frame member, and a pair of left and right side longitudinally extending frame members connected to said head end frame member and said foot end frame member.

3. The bed as set forth in claim 2, wherein:

said left and right side, longitudinally extending frame members of said bed frame comprise track members; and opposite sides of said sliding mechanism are disposed within said track members.

4. The bed as set forth in claim 3, wherein:

oppositely disposed external side portions of said sliding mechanism are provided with roller wheels for facilitating sliding of said sliding mechanism within said tracks defined within said left and right side, longitudinally extending frame members of said bed frame.

5. The bed as set forth in claim 3, wherein:

said pair of left and right side longitudinally extending frame members of said bed frame comprise longitudinally extending sections which are removably connected together by a connecting block of said bed frame; and said opposite sides of said sliding mechanism comprise longitudinally extending sections which are pivotally connected together by pivotal hinge mechanisms.

6. The bed as set forth in claim 5, wherein:

when said pivotal hinge mechanisms of said sliding mechanism are aligned with said connecting block of said bed frame, said bed can be folded in half so as to facilitate transportation and storage of said bed.

7. The bed as set forth in claim 1, wherein:

said bed further comprises a lumbar deck, at least one seat deck, a thigh deck, and a leg deck.

8. The bed as set forth in claim 7, wherein:

said at least one seat deck comprises a pair of seat decks.

9. The bed as set forth in claim 8, wherein:

said pair of seat decks are fixedly secured to said sliding mechanism.

10. The bed as set forth in claim 7, wherein:

said back deck, said lumbar deck, said at least one seat deck, said thigh deck, and said leg deck are pivotally connected to each other in a serial manner.

11. The bed as set forth in claim 7, further comprising:

a leg deck actuator mounted upon said sliding mechanism for moving said leg deck.

12. The bed as set forth in claim 11, wherein:

said back and leg deck actuators comprise linear actuators.

13. The bed as set forth in claim 7, further comprising:

a remote control unit operatively connected to said bed so as to elevate and lower said back and leg decks.

14. The bed as set forth in claim 1, wherein:

a headboard is attached to said head end frame member of said bed frame.

* * * * *